US006848939B2

(12) United States Patent
Stirling

(10) Patent No.: US 6,848,939 B2
(45) Date of Patent: Feb. 1, 2005

(54) COAXIAL CABLE CONNECTOR WITH INTEGRAL GRIP BUSHING FOR CABLES OF VARYING THICKNESS

(75) Inventor: Albert Stirling, Markham (CA)

(73) Assignee: Stirling Connectors, Inc., Indianapolis, IN (US)

( * ) Notice: Subject to any disclaimer, the term of this patent is extended or adjusted under 35 U.S.C. 154(b) by 0 days.

(21) Appl. No.: 10/602,003

(22) Filed: Jun. 24, 2003

(65) Prior Publication Data

US 2004/0266258 A1 Dec. 30, 2004

(51) Int. Cl.[7] ..... H01R 9/05
(52) U.S. Cl. ..... 439/578; 439/584; 439/587
(58) Field of Search ..... 439/578, 584, 439/587, 274, 275

(56) References Cited

U.S. PATENT DOCUMENTS

| | | | | | |
|---|---|---|---|---|---|
| 2,513,080 | A | | 6/1950 | Burtt | |
| 2,897,470 | A | | 7/1959 | Klassen | |
| 2,986,720 | A | | 5/1961 | Chess | |
| 3,671,926 | A | | 6/1972 | Nepovim | |
| 3,847,463 | A | | 11/1974 | Hayward | |
| 3,854,789 | A | | 12/1974 | Kaplan | |
| 3,997,230 | A | | 12/1976 | Secretan | |
| 4,296,986 | A | | 10/1981 | Herrmann | |
| 4,339,166 | A | | 7/1982 | Dayton | |
| 4,346,958 | A | | 8/1982 | Blanchard | |
| 4,405,196 | A | | 9/1983 | Fulton | |
| 4,431,255 | A | | 2/1984 | Banning | |
| 4,655,159 | A | * | 4/1987 | McMills | 116/212 |
| 4,746,305 | A | | 5/1988 | Nomura | |
| 4,834,675 | A | | 5/1989 | Samchisen | |
| 4,854,893 | A | | 8/1989 | Morris | |
| 4,902,246 | A | | 2/1990 | Samchisen | |
| 4,952,174 | A | | 8/1990 | Sucht | |
| 5,007,861 | A | | 4/1991 | Stirling | |
| 5,011,432 | A | | 4/1991 | Sucht | |
| 5,154,636 | A | | 10/1992 | Vaccaro | |
| 5,439,386 | A | | 8/1995 | Ellis | |
| 5,470,257 | A | | 11/1995 | Szegda | |
| 5,662,489 | A | | 9/1997 | Stirling | |
| 5,667,405 | A | | 9/1997 | Holliday | |
| 5,857,872 | A | * | 1/1999 | Tettinger | 439/584 |
| 5,863,220 | A | * | 1/1999 | Holliday | 439/584 |
| 6,102,738 | A | * | 8/2000 | Macek et al. | 439/584 |
| 6,261,126 | B1 | | 7/2001 | Stirling | |
| 6,331,123 | B1 | * | 12/2001 | Rodrigues | 439/584 |
| 6,520,800 | B1 | * | 2/2003 | Michelbach et al. | 439/578 |
| 6,530,807 | B2 | * | 3/2003 | Rodrigues et al. | 439/578 |
| 6,575,786 | B1 | * | 6/2003 | Khemakhem et al. | 439/580 |

FOREIGN PATENT DOCUMENTS

| | | |
|---|---|---|
| CA | 2043532 | 10/1994 |
| CA | 2179003 | 8/2002 |
| CA | 2207287 | 8/2002 |

* cited by examiner

*Primary Examiner*—Gary Paumen
(74) *Attorney, Agent, or Firm*—Krieg DeVault Lundy LLP

(57) ABSTRACT

A connector is provided for interconnecting a coaxial cable to an electrical device. The connector has an internal body and an external body which are assembled together, and which can be activated to clamp upon and seal to an inserted coaxial cable without disassembling the external body from the internal body. The external body includes a deformable inner collar that permits the connector to be attached and sealed to cables of varying thickness as are found on common single foil and braid cable, Tri Shield cable and Quad Shield cable.

17 Claims, 1 Drawing Sheet

COAXIAL CABLE CONNECTOR WITH INTEGRAL GRIP BUSHING FOR CABLES OF VARYING THICKNESS

FIELD OF THE INVENTION

This invention relates generally to a connector for coaxial cable, such as the type used for cable TV transmission.

BACKGROUND OF THE INVENTION

Coaxial cable connectors that require crimping are associated with certain disadvantages. Crimping tools tend to wear out with repeated use, and crimping does not provide a satisfactory seal. A number of crimpless connectors have been developed which attempt to overcome these problems.

One type of crimpless connector receives a compression sleeve, which is first broken away from a plastic ring mounted on the connector, and then slid over the cable and finally inserted into the annular cavity between the inner wall of the connector and the jacket of the cable. A tool is used to push the compression sleeve fully into the connector with a snap engagement.

A problem with this connector is that it can be awkward to break the compression sleeve away from the connector and then thread it onto the cable, particularly when used in field installations where there may be adverse weather conditions. The compression sleeve can as well be inadvertently threaded onto the cable backwards, and it can also be dropped and lost.

An alternative crimpless connector has more recently been provided, which permits the cable to be secured to it by means of an integral grip bushing that surrounds an internal mandril defining an annular gap that may receive the jacket and braiding of an inserted cable. The bushing can thereafter be moved so as to squeeze and hold the braiding and jacket of the cable, forming a seal therewith. While this grip bushing cable connector has many advantages, it does not lend itself to use with coaxial cables of different thicknesses.

Within the cable television industry, RG6 and RG59 cable are the most prevalent standard. Common RG6 and RG59 cable has a central conductor, a dielectric insulator with a single aluminum foil cover, one layer of braided shield surrounding the foil covered dielectric insulator, and a plastic insulating jacket covering the braided shield.

In addition to common RG6 and RG59 cable, so called "Tri Shield" and "Quad Shield" versions are also increasingly widely used. Tri Shield cable has a second layer of foil which covers the braided shield. Quad Shield cable has both a second layer of foil and a second layer of braided shield over the second layer of foil.

As a result of the additional shielding layers, Tri Shield and Quad Shield RG6 and RG59 cables have overall thicknesses or diameters greater than that of common RG6 and RG59 cable. The standard diameter of common RG6 cable, for example, is 0.272 inches. For Tri Shield RG6 cable the standard diameter is 0.278 inches. For Quad Shield RG6 cable the standard diameter is 0.293 inches.

Due to the close tolerances required for the known grip bushing connectors, a single connector cannot properly accommodate and attach to all three thicknesses of cable. At least two different sizes of connector are required: one for common cable and Tri Shield cable, and a second one for Quad Shield cable.

This situation is inconvenient for installation technicians, and represents an undesirable cost to cable television companies and suppliers. Not only do two separate inventories of connectors have to be maintained, the two different sizes of connectors can be easily mixed up, leading to installation difficulties.

BRIEF SUMMARY OF THE INVENTION

The purpose of the present invention is to obviate or mitigate the disadvantages of known connectors for coaxial cable.

In accordance with the invention, a connector is provided for use with coaxial cables of the type having a central conductor, a dielectric insulator with at least one foil cover encasing the central conductor, and either one or more layers of braided shield around the dielectric insulator beneath an outer jacket.

The connector comprises an internal body, threaded nut means for interconnecting the connector to a mating connector or port, and an external body that includes a deformable inner collar, assembled together so as to resist subsequent disassembly. The connector is adapted to receive and to tightly hold and seal to cables of different thicknesses, such as common RG6 cable, Tri Shield RG6, and also Quad Shield RG6 cable.

The internal body is preferably in the form of a mandril that has a bore of a diameter to receive the dielectric insulator of the coaxial cable. The mandril has a sleeve with an end adapted to engage the cable beneath the jacket and the braided shield, whether the braided shield is in one layer, as in common RG6 cable and Tri Shield RG6 cable, or more layers, as in Quad Shield RG6 cable.

The threaded nut means is rotatably engaged to the mandril at the end which is remote from the sleeve end that is adapted to engage the cable.

The internal body also includes a cylindrical wall concentric to the sleeve of the mandril, defining an annular channel between them which is dimensioned to receive the jacket and the braided shield of an inserted cable, with a gap between the jacket and the wall. The size of the gap depends on the thickness of the cable, that is, the number of layers of braided shield.

The external body is preferably in the form of a gripping bushing that is mounted to the connector surrounding a portion of the mandril and concentric to it. At its free end it has a mouth of a diameter to receive the cable. The deformable inner collar of the external body is preferably positioned proximal to the mouth of the bushing.

The bushing is moveable from a first position in which the collar is remote from the annular gap, to a second position in which the collar is partially within the annular gap.

The connector can be attached to a cable by inserting the cable into the mouth of the bushing while it is in its first position, pushing the dielectric insulator of the cable into the bore of the mandril with the sleeve end thereof engaging beneath the braided shield and the jacket of the cable, and subsequently moving the bushing to its second position, thereby wedging the inner collar into the annular gap, where it becomes deformed to fill the annular gap and squeezes the braided shield and jacket of the cable, holding it tightly and sealing the connector to it.

Preferably, the connector includes an O ring retained in a groove on the mandril sealing it to the threaded nut means.

A single size of connector of the present invention can be used with common RG6 and Tri Shield RG6 cable, and also with Quad Shield RG6 cable. The invention thus eliminates the need to have two sizes of grip bushing connectors for these different sizes of cables.

BRIEF DESCRIPTION OF THE DRAWINGS

In order that the invention may be more clearly understood, reference will be made to the accompanying drawings which illustrate a preferred embodiment of the coaxial cable connector of the present invention, and in which.

DESCRIPTION OF THE PREFERRED EMBODIMENT

Figure 1:
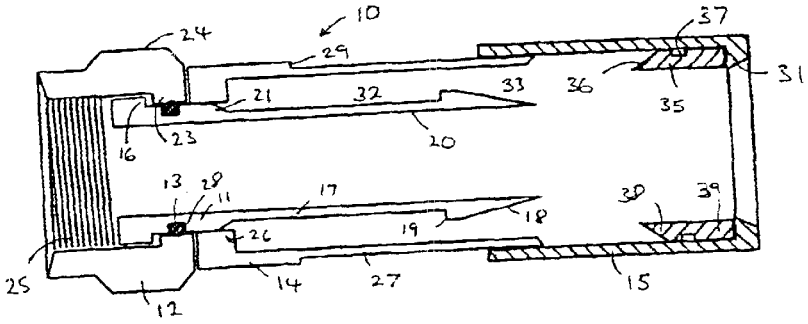
FIG. 1 is a cross-sectional side view of a cable connector of the present invention.

In the drawings, the coaxial cable connector is denoted generally by reference number 10. The cable is denoted by reference number 40 and is of a standard configuration comprising a central conductor 41, a dielectric insulator 42 with a foil cover 43, a braided shield 44 and a plastic jacket 45.

The connector 10 comprises a mandril 11, a nut member 12, an O-ring 13, a retainer 14 and a bushing 15 having an internal collar 35. The O-ring 13 is made of a compressible, elastomeric material, such as rubber or plastic. The mandril 11, nut member 12, retainer 14, and bushing 15 are all made of a rigid material, preferably metallic, such as brass. The collar 35 of the bushing 15 is made of a deformable material such as Delrin®, an acetal resin available from E.I. Dupont de Nemours and Company.

The mandril 11 is generally cylindrical having an enlarged base with a sleeve 17 extending therefrom. A flange 16 projects outwardly from the end of the enlarged base of the mandril 11. The sleeve 17 has a tapered end 18 with a barb 19. A bore 20 extends through the mandril 11 having a diameter to receive the dielectric 42 and its foil cover 43 and the conductor 41.

The nut member 12 is mounted rotatably to the mandril 11. The nut member 12 has an inwardly projecting flange 23 that engages the flange 16 of the mandril 11 to permit free rotation between the nut member 12 and the mandril. The nut member 12 is provided with internal threads 25 and hexagonal flats 24.

The enlarged base 21 of the mandril 11 has an annular groove 28 in which sits the O-ring 13. The O-ring 13 is of a size and dimension to seat in the annular groove 28, and to contact sealingly with the flange 23 of the nut member 12.

The retainer 14 is generally cylindrical and is fixedly mounted to the mandril 11. The retainer 14 has a base 26 with a wall 27 extending therefrom. The base 26 has an internal diameter that allows it to be mounted to the enlarged base 21 of the mandril 11 and held securely by frictional engagement. The sleeve 17 of the mandril 11 and the wall 27 of the retainer 14 define an annular cavity 32 with a tapered entry 33.

The bushing 15 is also cylindrical and has a mouth 31 at one end dimensioned to receive the coaxial cable 40. The other end of the bushing 15 is adapted to be mounted to the retainer 14 with a close fitting slidable engagement.

Figure 4:
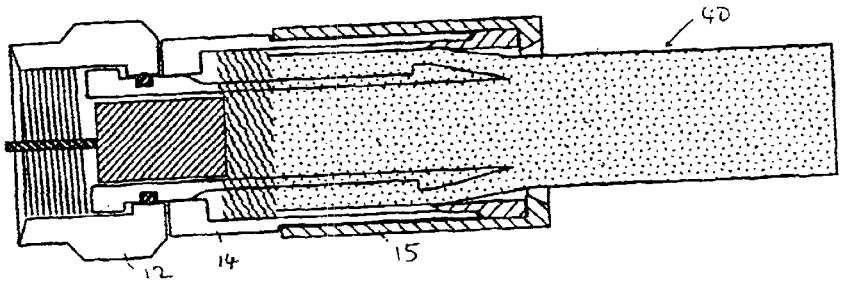
FIG. 4 is a cross-sectional side view of the same connector as in FIG. 3, with the outer bushing of the connector having been moved from its original position, in which the connector can receive the coaxial cable, to its final position, in which the connector tightly holds the inserted coaxial cable and forms a seal therewith.

The wall 27 of the retainer 14 has a stepped external surface such that a step 29 provides a positive stop for the bushing 15 to seat against when the bushing 15 has been activated to slide into its clamping position, as shown in FIG. 4.

The bushing 15 has an internal collar 35 made of a deformable plastic material, such as Delrin®. The collar 35 is generally cylindrical and is retained within the bushing proximal the mouth 31. The outward facing rim 39 of the collar 35 is generally flat and seats at the mouth end of the bushing 15. The inward facing rim 38 of the collar 35 has a tapered edge 36. The collar 35 also has an external annular groove 37.

The connector 10 is assembled by first mounting the O-ring 13 to the mandril 11, then mounting the nut member 12, and subsequently mounting the retainer 14, which prevents the O-ring 13 and the nut member 12 from subsequent removal from the mandril 11. The collar 35 is inserted into the bushing 15. Finally, the bushing 15 is mounted to the retainer 14 as shown in FIG. 1.

In mounting the connector 10 to the coaxial cable 40, the cable is first prepared by exposing a length of the central conductor 41, and also stripping a further length of the dielectric 42 and foil-cover 43. The braided shield 44 is cut slightly longer than the jacket 45 and is folded back over the edge thereof, as shown in FIG. 2.

Figure 2:
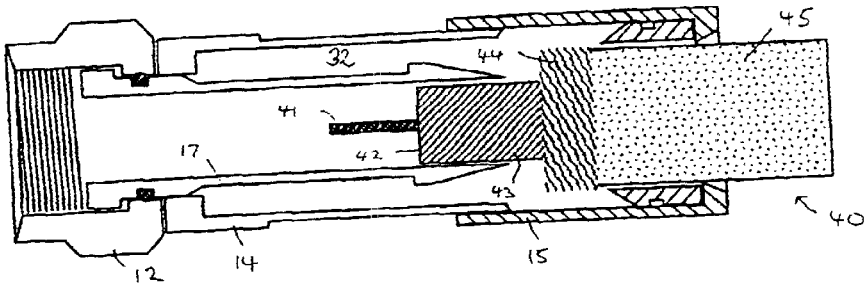
FIG. 2 is a cross-sectional side view of the same connector as shown in FIG. 1, with a coaxial cable having been inserted therein.
Figure 3:
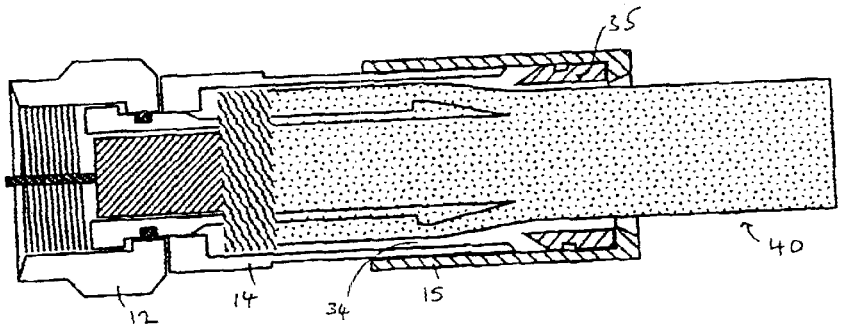
FIG. 3 is a cross-sectional side view of the same connector as in FIG. 2, with the coaxial cable having been inserted further therein.

Attachment of the connector 10 to the cable is shown in FIGS. 2–4. The prepared cable 40 is first inserted into the connector 10 such that the conductor 41, the dielectric 42 and the foil 43 are received within the bore 20 of the mandril 11. The tapered end 18 of the mandril slides beneath the braided shield 44 and the jacket 45 of the cable 40. The barb 19 on the sleeve 17 of the mandril 11 resists subsequent removal of the cable 40 from the mandril 11.

The trimmed end of the jacket 45 of the cable 40 and the folded back portion of the braided shield 44 are accommodated within the annular cavity 32, entering at the tapered entry 33.

When the cable 40 has been fully inserted into the connector 10 such that the conductor 41 extends into the nut member 12, the connector is placed in a levered squeezing tool (not shown) by means of which the bushing 15 can be forced to slide over the retainer 14.

As the bushing is moved the tapered edge 36 of the inner collar is inserted in the entry 33 of the annular cavity 32, between the end 18 of the sleeve 17 of the mandril 11 and the end of the wall 27 of the retainer 14. The inward facing rim 38 of the inner collar 35 is deformed to fill the gap 34 between the jacket 45 of the cable 40 and the retainer wall 27, such that the cable 40 is clamped tightly and sealed by the connector 10 when the bushing 15 is squeezed fully onto the retainer 14. The collar 35 deforms so as completely to fill the gap 34 between the cable 40 and the retainer wall 27 whether the cable has either one or two layers of braided shield 44 beneath the outer jacket 45. The annular groove 37 of the collar 35 provides a region of weakness to promote the desired deformation of the collar 35 when the bushing 15 is compressed within the retainer 14.

It will of course be appreciated that many variations are possible within the broad scope of the invention. For example, the retainer and mandril could be an integral body. The configuration of the connector and its component parts could also be modified. Means other than the threaded nut member could be substituted for engagement of the connector to an electronic device. The O-ring could be replaced with a different type of sealing means between the mandril and the nut member, and the placement of such O-ring or other sealing means could as well be altered. Moreover, the connector can be dimensioned for use with RG59 or other cables as well as RG6 cable.

I claim:

1. A connector for coaxial cables having a foil covered dielectric insulator encasing a central conductor, and either one or two layers of braided shield around the dielectric insulator beneath an outer jacket, said connector comprising:

a mandril with a bore of a diameter to closely receive the dielectric insulator of such coaxial cable, having at a first end thereof a sleeve adapted to engage the cable beneath the braided shield and the jacket;

threaded nut means rotatably and sealingly engaged to said mandril at the second end thereof, for interconnecting said connector to a mating connector or port;

a retainer fixed to said mandril, having a generally cylindrical wall concentric to said sleeve of said mandril defining an annular channel therebetween, said channel being dimensioned to receive the braided shield and the jacket of the cable, with an annular gap between the jacket and the retainer wall;

a bushing disposed around a portion of said retainer and concentric thereto, having at its free end a mouth of a diameter to closely receive the cable, said bushing having a deformable collar therein, and said bushing being moveable from a first position in which said collar of said bushing is remote from said annular gap, to a second position in which said collar is wedged into said annular gap, deforming therein so as to squeeze the braided shield and the jacket of the cable and thereby tightly hold the cable and seal it to said connector.

2. The connector of claim 1, wherein said mandril has a flange at said second end which retains said nut means.

3. The connector of claim 2, wherein said nut means has a flange opposing said flange of said mandril.

4. The connector of claim 3, wherein said sleeve is tapered and barbed.

5. The connector of claim 4, wherein said bushing is engaged to said retainer by close frictional contact, and is moveable slidingly from said first position to said second position by means of a squeezing tool.

6. The connector of claim 5, further comprising an O-ring retained upon said mandril and proximal said second end thereof, dimensioned to form a seal between said mandril and said nut means.

7. The connector of claim 6, wherein said O-ring is held in a groove on said mandril, in contact with said flange of said nut means.

8. The connector of claim 7, wherein said retainer is fixed to said mandril proximal said second end thereof.

9. A connector for coaxial cables having a foil covered dielectric insulator encasing a central conductor, and either one or multiple layers of braided shield around the dielectric insulator beneath an outer jacket, said connector comprising:

an internal body having a bore of a diameter to receive the dielectric insulator of such a coaxial cable, and having a sleeve with an end adapted to engage the cable beneath the braided shield and the jacket, and said internal body also having a generally cylindrical wall concentric to said sleeve defining an annular channel therebetween dimensioned to receive the braided shield and the jacket of the cable, with an annular gap between the jacket and the wall;

threaded nut means rotatably mounted to said internal body, remote from said sleeve end thereof, for interconnecting said connector to a mating connector or port;

an external body surrounding a portion of said internal body, having at a free end thereof a mouth of a diameter to receive the cable, said mouth being generally concentric with said bore of said internal body, said external body having an inner deformable collar proximal said mouth, said external body being assembled with said internal body and said rotatable nut means so as to resist subsequent disassembly, and said external body being moveable without disassembly from said internal body, from a first position in which said collar is remote from said annular gap, to a second position in which said collar is partially within said annular gap, such that said connector can be attached to the cable by inserting the cable into said mouth of said external body while said external body is in said first position, and pushing the dielectric insulator of the cable into the bore of the internal body with said sleeve end thereof engaging beneath the braided shield and the jacket of the cable, and subsequently moving said external body to said second position, thereby wedging said collar into said annular gap, deforming therein, so as to squeeze the braided shield and the jacket of the cable and thereby tightly hold the cable and seal it to said connector.

10. The connector of claim 9, wherein said internal body and said external body are generally cylindrical and concentric with each other.

11. The connector of claim 10, further comprising sealing ring means disposed around said internal body and sealingly contacting said nut means.

12. The connector of claim 11, wherein said mandril has a flange remote from said sleeve end which retains said nut member.

13. The connector of claim 12, wherein said sleeve end is tapered and barbed.

14. The connector of claim 13, wherein said bushing is assembled with said connector by close frictional contact, and is moveable slidingly from said first position to said second position by means of a squeezing tool.

15. The connector of claim 14, wherein said bushing slides over said sealing means when moved into said second position, thereby forming a compressive moisture proof seal between said bushing and said mandril and said nut means.

16. The connector of claim 1 or claim 9, wherein said deformable collar is plastic.

17. The connector of claim 1 or claim 9, wherein said deformable collar has an inwardly tapered edge.

* * * * *